US005705204A

United States Patent [19]

Hofmeister et al.

[11] Patent Number: 5,705,204

[45] Date of Patent: Jan. 6, 1998

[54] MODEL FOR A CASTING MOLD

[75] Inventors: Heinz Hofmeister, Tettnang; Helmut Schmollinger, Brochenzell, both of Germany

[73] Assignee: MTU Motoren- Und Turbinen-Union Friedrichshafen GmbH, Friedrichshafen, Germany

[21] Appl. No.: 585,686

[22] Filed: Jan. 16, 1996

Related U.S. Application Data

[63] Continuation-in-part of Ser. No. 214,260, Mar. 17, 1994, abandoned.

[30] Foreign Application Priority Data

Mar. 17, 1993 [DE] Germany ..... 43 08 483.4

[51] Int. Cl.[6] ..... B29C 33/52

[52] U.S. Cl. ..... 425/468; 249/176; 249/177; 249/184; 249/DIG. 59; 264/318; 425/DIG. 58

[58] Field of Search ..... 425/468, DIG. 58; 264/59, 177, 184, 186, 142, 318; 249/176, 177, 184, DIG. 59

[56] References Cited

U.S. PATENT DOCUMENTS 4,706,928 11/1987 Hyll ..... 249/184
5,435,960 7/1995 Bressler et al. ..... 249/62

FOREIGN PATENT DOCUMENTS 35 30 163 3/1987 Germany .

*Primary Examiner*—Tim Heitbrink
*Attorney, Agent, or Firm*—Evenson, McKeown, Edwards & Lenahan, P.L.L.C.

[57] ABSTRACT

A model for a casting mold, particularly for the casting of blade wheels for turbo-engines, includes multiple cores which can be fitted into one another. The cores have exterior rings, portions of blade duct cores and connector plates. The portions of the blade duct cores supplement one another.

13 Claims, 11 Drawing Sheets

MODEL FOR A CASTING MOLD

This application is a continuation-in-part of U.S. application Ser. No. 08/214,260 filed on Mar. 17, 1994 now abandoned.

BACKGROUND AND SUMMARY OF THE INVENTION

This invention relates to a model or pattern for a casting mold and, more particularly, to a model or pattern for the casting of blade wheels for turbo-engines. The model or pattern has cores which can be fitted into one another forming a core assembly group for the casting mold.

The majority of blade wheels for turbo-engines are cast. According to the known state of the art, because the surfaces of the blade wheels are physically very curved, the model or pattern of the casting mold used for this purpose must be assembled from a number of segments which corresponds to the number of blades of the blade wheel. The assembling of the model or pattern from many different pieces or parts is labor-intensive and, even when extreme care is used, results in dimensional imperfections on the cast part which must be eliminated by means of cost-intensive finishing.

From German Patent document DE OS 35 30 163, it is known to manufacture a model for a casting mold with two pieces. These pieces are also called cores. The contact surfaces of the two cores, which can be fitted into one another, have a conical construction and are fixed with respect to one another by additional guide noses. The contact surfaces are geometrically complicated and their manufacturing is therefore expensive. Defined fixed stops are not provided in the contact surfaces which allows the two cores to slide relative to one another. This results in dimensional inaccuracies on the cast parts. The guide noses represent additional constructive expenditures. In order to be able to reliably and precisely hold the cores in a predetermined position with respect to one another, the guide noses must be dimensionally stable and have a precise fit. This results in high manufacturing costs.

There is therefore needed a model or pattern for a casting mold which is simple to mount, ensures precise dimensions on the cast part, and therefore provides an altogether less expensive manufacturing of the finished cast part.

These needs are met by a model or pattern for a casting mold having cores which can be fitted into one another to form a core assembly group for the casting mold. The terms "model" and "pattern" are used interchangeable throughout the specification. These terms are the English language translation for the German word "Modell" found in the corresponding German application upon which priority is based.

A first core has a shoulder from which first blade-shaped segments lead to a first connector plate. A second core rests radially via an exterior ring against the shoulder. Second blade-shaped segments lead from the exterior ring to a second connector plate. The second blade-shaped segments and/or the exterior ring rest tangentially against the first blade-shaped segments.

Through the use of large contact surfaces, which can be manufactured at reasonable cost, the device according to the present invention determines the position of the cores of the model with respect to one another in a clear and simple manner. When individual cores are used, the imbalance caused by tilting of the individual cores, the summation of all dimensional deviations of the individual cores, or an insufficiently closed mounting device, are largely avoided, and the expenditures with respect to balancing are reduced to a minimum. A shoulder on the circumference of a first core rests by means of a lower and a lateral leg directly against a lower molding box. Because of the large plane contact surfaces, the shoulder provides a particularly stable bearing for the model. The shoulder is used for the bearing of a second core whose exterior ring rests against the lower and lateral leg of the shoulder, and clearly determines the radial and axial position of the second core. By means of the shoulder and the exterior ring, the first, as well as the second, core obtain a high dimensional stability. Blade-shaped segments form one piece with the shoulder and a connector plate of the first core. Complementary blade-shaped segments are in one piece with the exterior ring and another connector plate of the second core. The blade-shaped segments of the first core are used as a stop face for the exterior ring and the blade-shaped segments of the second core, and clearly determine its angular position relative to the first core. In addition, the connector plates have a stabilizing effect on the cores and their blade-shaped segments.

According to another advantageous development of the present invention, the blade-shaped segments of the model are essentially constructed such that, in the case of torques occurring about the joint axis of rotation of the cores, no force components arise on the contact surfaces of the blade-shaped segments in parallel to the plane of the contact surfaces. In this manner, a sliding-open of the contact surfaces and thus a sliding off-center of the core with respect to one another can be avoided.

The practical benefit of the invention is further increased by the fact that the concentric connector plates simplify, on the one hand, the manufacturing of the cores of the model and, on the other hand, the control of the correct assembly. In addition, the shoulders on the connector plates according to the present invention improve the load distribution from one core to the other.

Particularly strong curved blade wheel surfaces can be modeled only if the model is subdivided via a third core for the purpose of mold casting.

The third core is preferably connected with a ring-shaped core mark and must be disposed on the second core.

Advantageously, the third core is provided on its outer circumference with sections and shoulders for the purpose of securing the first and second cores with respect to twisting.

The proper assembly of the core of the model according to the present invention will be particularly easy for the modeler when the blade-shaped segments of the first core are complementary to recesses on the ring of the second core. This is so that a plane surface is obtained from the joined areas of the shoulder, the blade-shaped segments of the first core and the exterior ring of the second core.

Other objects, advantages and novel features of the present invention will become apparent from the following detailed description of the invention when considered in conjunction with the accompanying drawings.

DETAILED DESCRIPTION OF THE DRAWINGS

Figure 1:
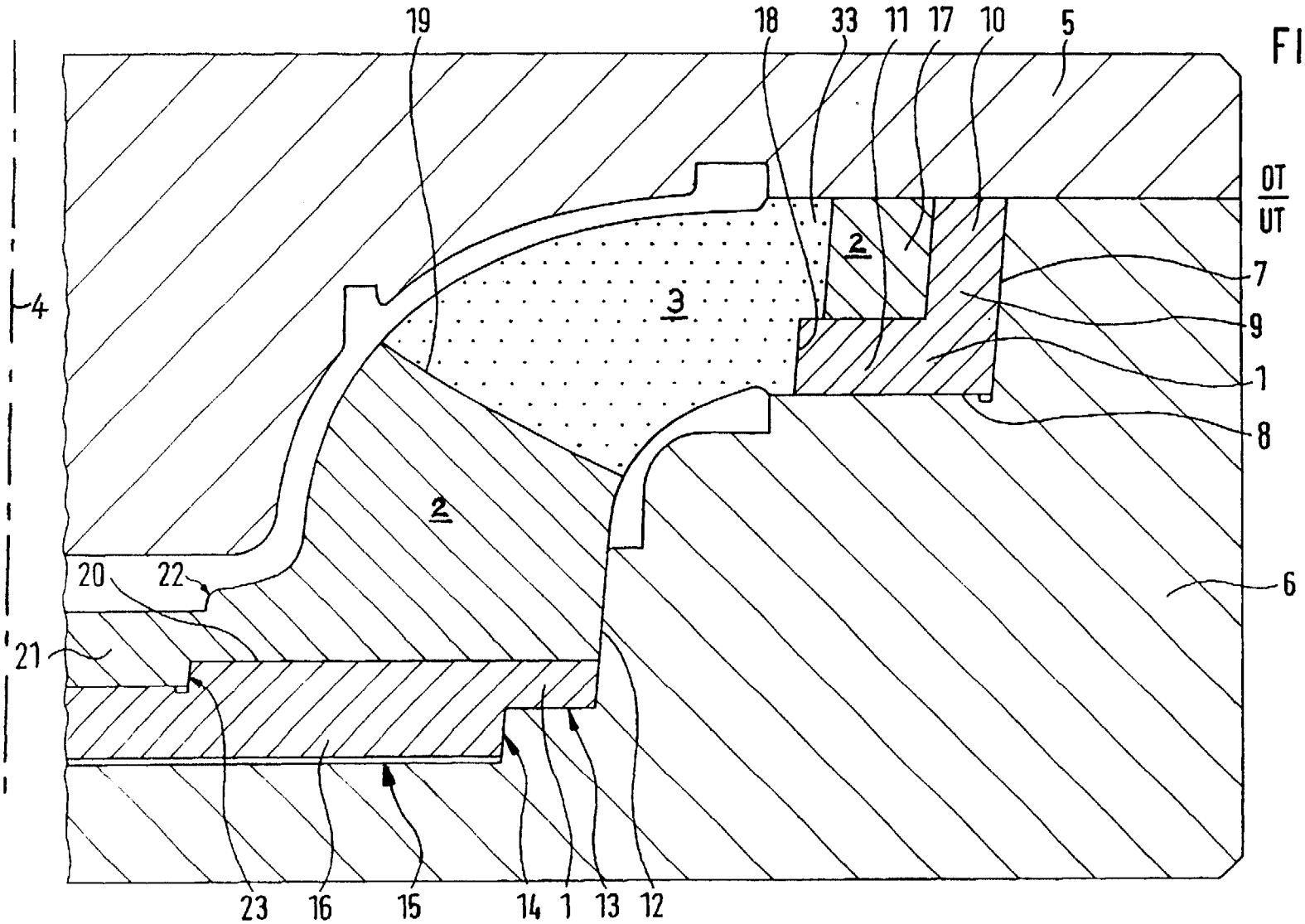
FIG. 1 is a cross-sectional view of the model or pattern according to the present invention in a molding box unit.

FIG. 1 illustrates a cross-section of one half of the model or pattern according to the present invention. The model has three cores 1, 2, 3 which are rotationally symmetrical with respect to an axis 4 and can be fitted together as a core assembly group. The model is situated in a molding box unit whose upper box 5 is disposed on a lower box 6. The lower box 6 is provided with rotationally symmetrical receiving surfaces 7, 8 for a shoulder 9 of the core 1. One leg 10 of the shoulder 9 rests against receiving surface 7, and one leg 11 rests against receiving surface 8 of the lower box 6. By means of exterior sections 18, core 3 is also supported on surface 8 as well as via shoulders 33 on leg 11 of core 1. Core 1, as well as core 2, rest against another rotationally symmetrical receiving surface 12 of the lower box 6. A connector plate 16 of core 1 rests against receiving surfaces 13, 14 and 15 of the lower box 6.

The cross-sectional view of FIG. 1 illustrates the shoulder 9 and the connector plate 16 of core 1. An exterior ring 17 of core 2 rests against the legs 10, 11 of the shoulder 9. The shoulder 9 and the ring 17 are circular, which makes the manufacturing of dimensionally precise contact surfaces in a technically simple and low-cost manner possible. The shoulders 33 of core 3 engage in recesses 34 (FIG. 2) of the ring 17 and secure core 3 to prevent twisting relative to core 2. By means of sections 18, core 3 rests against the leg 11 of shoulder 9. In the vertical and radial direction, core 3 is supported on the inner circumference via essentially plane contact surfaces 19 on core 2. By means of a plane contact surface 20, core 2 is in contact with the connector plane 16 of core 1. Via a circular shoulder 22, a connector plate 21 forms one piece with core 2. Connector plate 16 has a shoulder 23 which rests against a step of connector plate 21.

Figure 2:
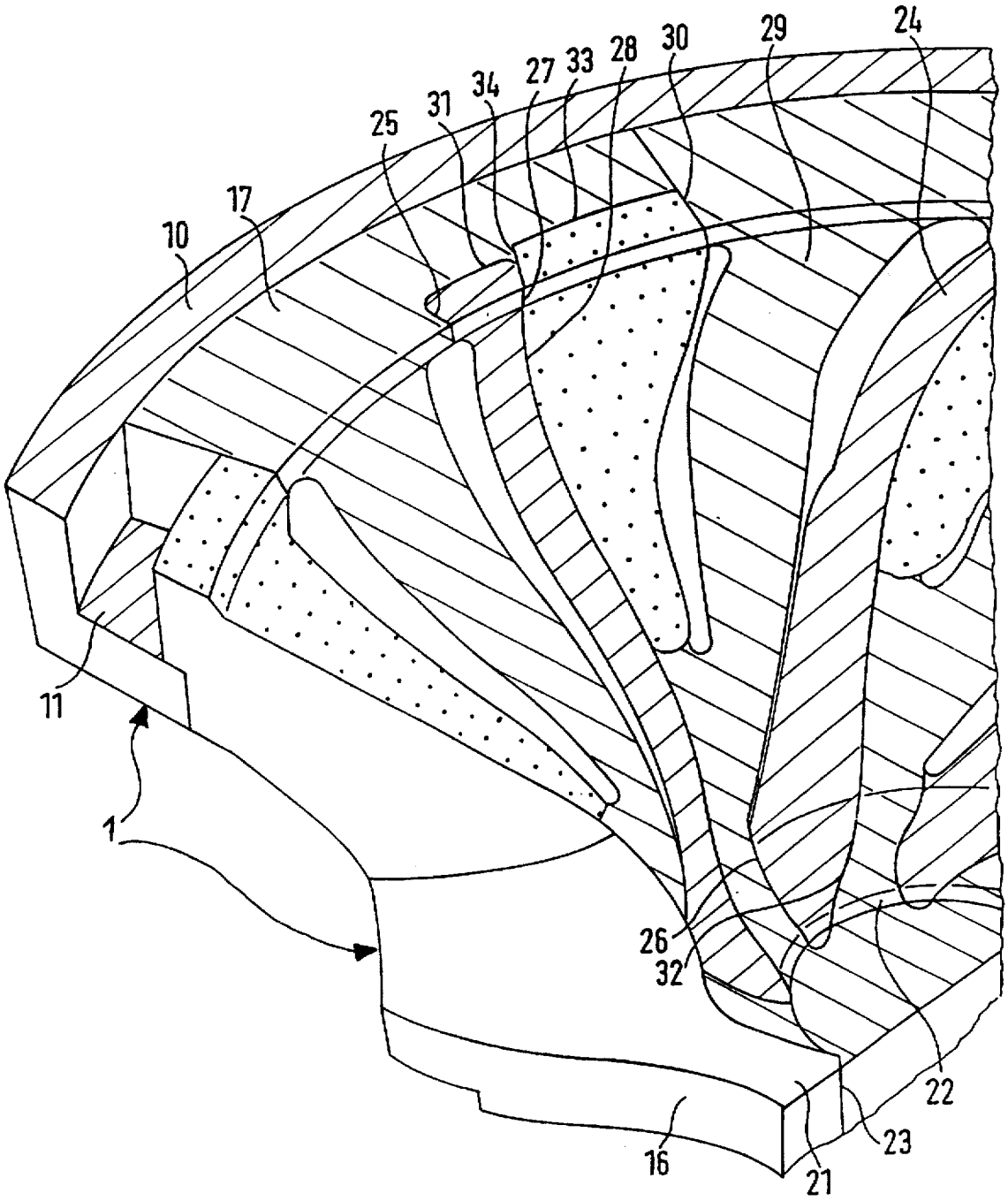
FIG. 2 is a perspective representation of cores which are fitted into one another as a core assembly group forming the model or pattern used in the casting mold according to the present invention.

FIG. 2 represents an angular range of the model cores 1 and 2 of approximately 120°. The cores 1 and 2 are fitted into one another, according to the present invention. In the circumferential direction, the exterior ring 17 of the core 2 rests against blade-shaped segments 24 on stops 25 of core 1. The blade-shaped segments 24 have additional contact surfaces 26 which are essentially in parallel to the joint axis 4 of the cores 1, 2, 3 and extend from the stops 25 to the shoulder 23. On the side opposite the stop 25, in parallel to axis 4, the blade-shaped segments 24 each have another stop 27 and a contact surface 28. The contact surface 28 extends to the shoulder 23.

Blade-shaped segments 29 form one piece with the exterior ring 17 of core 2 and extend to the shoulder 22 of the connector plate 21. On the circumference of the blade-shaped segments 29, the exterior ring 17 forms stops 30 which rest radially against the leg 11 of the shoulder 9 of the core 1. The exterior ring 17 of core 2 contains recesses 31 into which the blade-shaped segments 24 of core 1 project.

Figure 11:
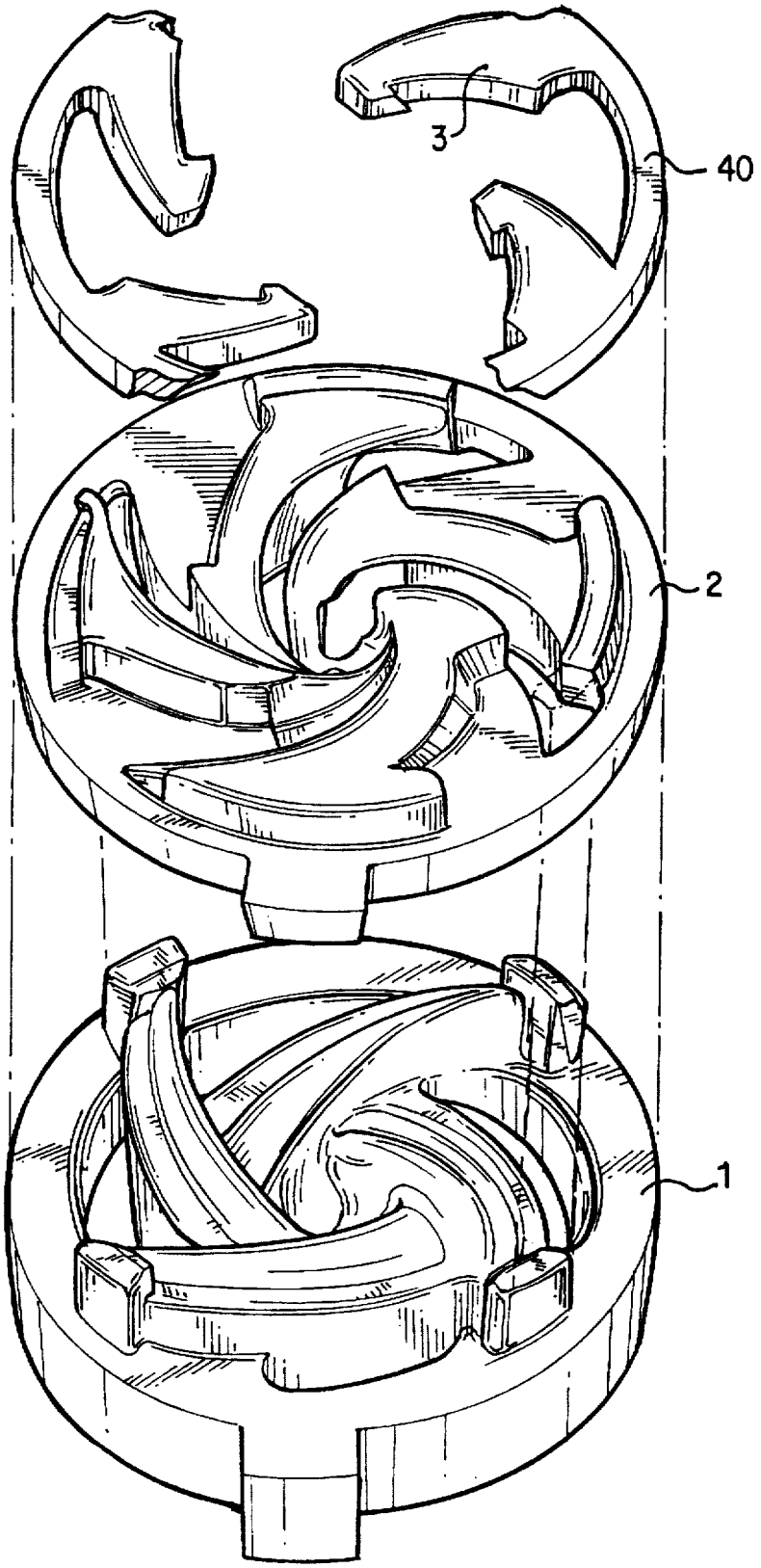
FIG. 11 is an exploded view of an embodiment of the present invention illustrating the fitting of the cores together using a ring-shaped case mark to form the pattern used in the casting mold.

Stops 30 are used as a circumferential contact for sections 18 of core 3. The recesses 31 in the exterior ring 17 receive the sections 18 of core 3 which hold core 3 against the stops 27 of core 1 so that it is secure with respect to twisting. Additional recesses 34 in ring 17 receive shoulders 33 of core 3 and secure core 3 with respect to a twisting relative to core 2. The cores 3 used in the pattern are connected together via a ring-shaped core mark as shown in FIGS. 11 and 12 described below.

The blade-shaped segments 29 have contact surfaces 32 which are in parallel to axis 4. The contact surfaces 32 change into the connector plate 21 on shoulder 22° The contact surfaces 32 are complementary to the contact surfaces 26, 28 of the blade-shaped segments 24 and enclose these contact surfaces 26, 28 completely in the area of the transition from the blade-shaped segments 24, 29 to the shoulders 22, 23.

Figure 3:
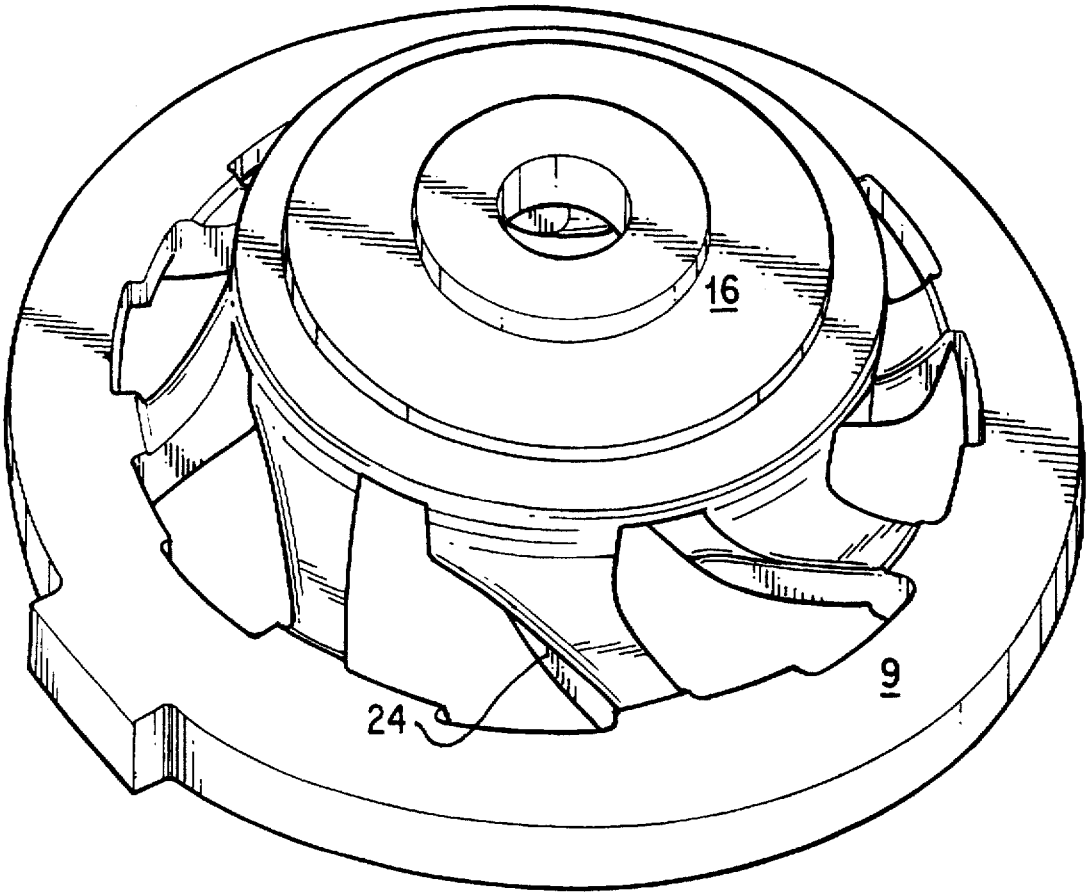
FIG. 3 is a perspective view of a first core forming the pattern used in the casting mold, viewed from the bottom.
Figure 4:
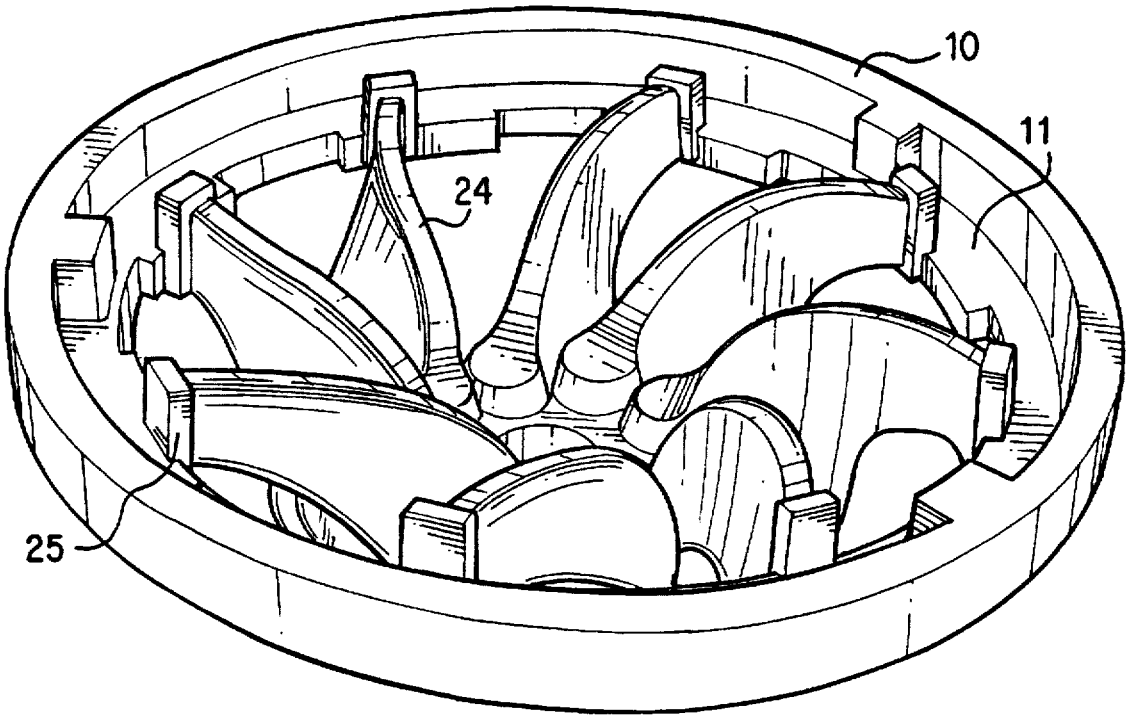
FIG. 4 is a perspective view of the first core from the top illustrating the blade shaped segments.

Referring to FIG. 3, a bottom perspective view of the entire core 1 is shown illustrating the circular shoulder 9 and the connector plate 16. The top perspective view of the entire core 1 shown in FIG. 4 further illustrates the legs 10, 11 forming the shoulder 9 as well as the blade shaped segments 24 which extend from the shoulder 9 to the connector plate 16. The blade shaped segments 24 further include stops 25 as are clearly illustrated in FIG. 4.

Figure 5:
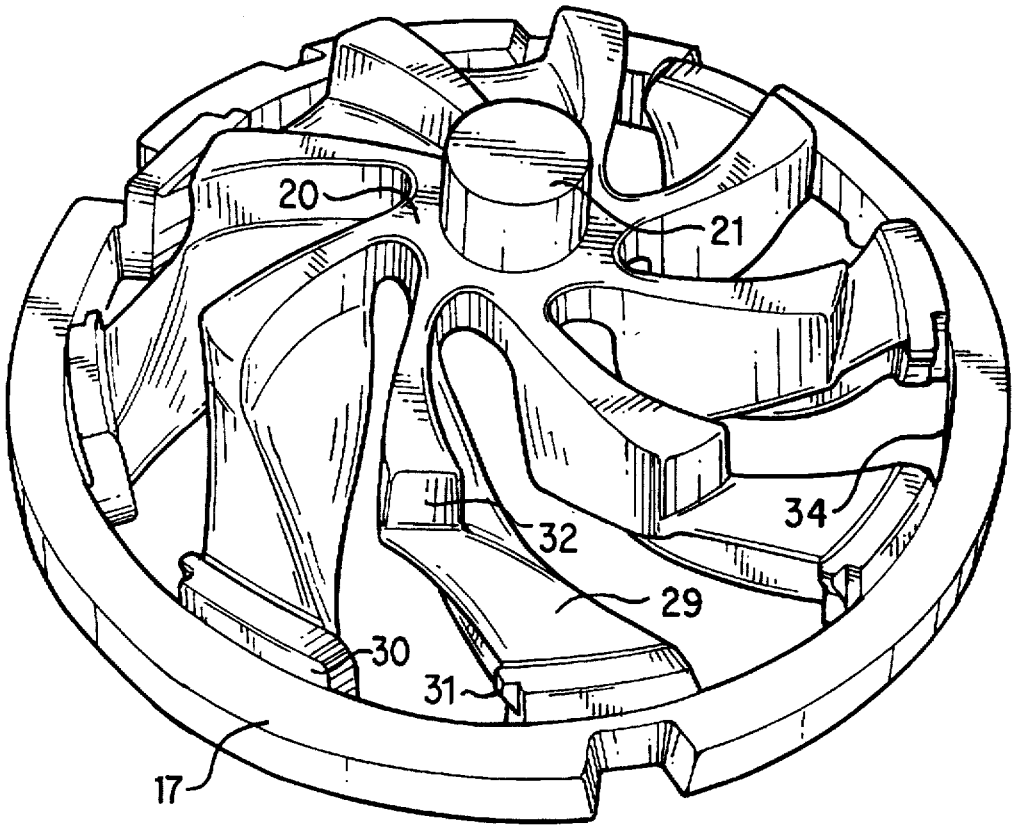
FIG. 5 is a perspective view illustrating a second core forming the pattern used in the casting mold, viewed from the bottom.

Referring to FIG. 5, a bottom perspective view of the entire second core 2 is illustrated. The circular exterior ring 17 of the second core 2 is connected to the connector plate 21 via the blade shaped segments 29 having the contact surfaces 32 which change into the connector plate 21 at the contact surface 20. As is shown in FIG. 5, the exterior ring 17 includes stops 30 which radially rest against leg 11 of the shoulder 9 of the core 1 as shown in FIG. 2. Further, the exterior ring includes recesses 31 in which are received sections 18 of core 3.

Figure 6:
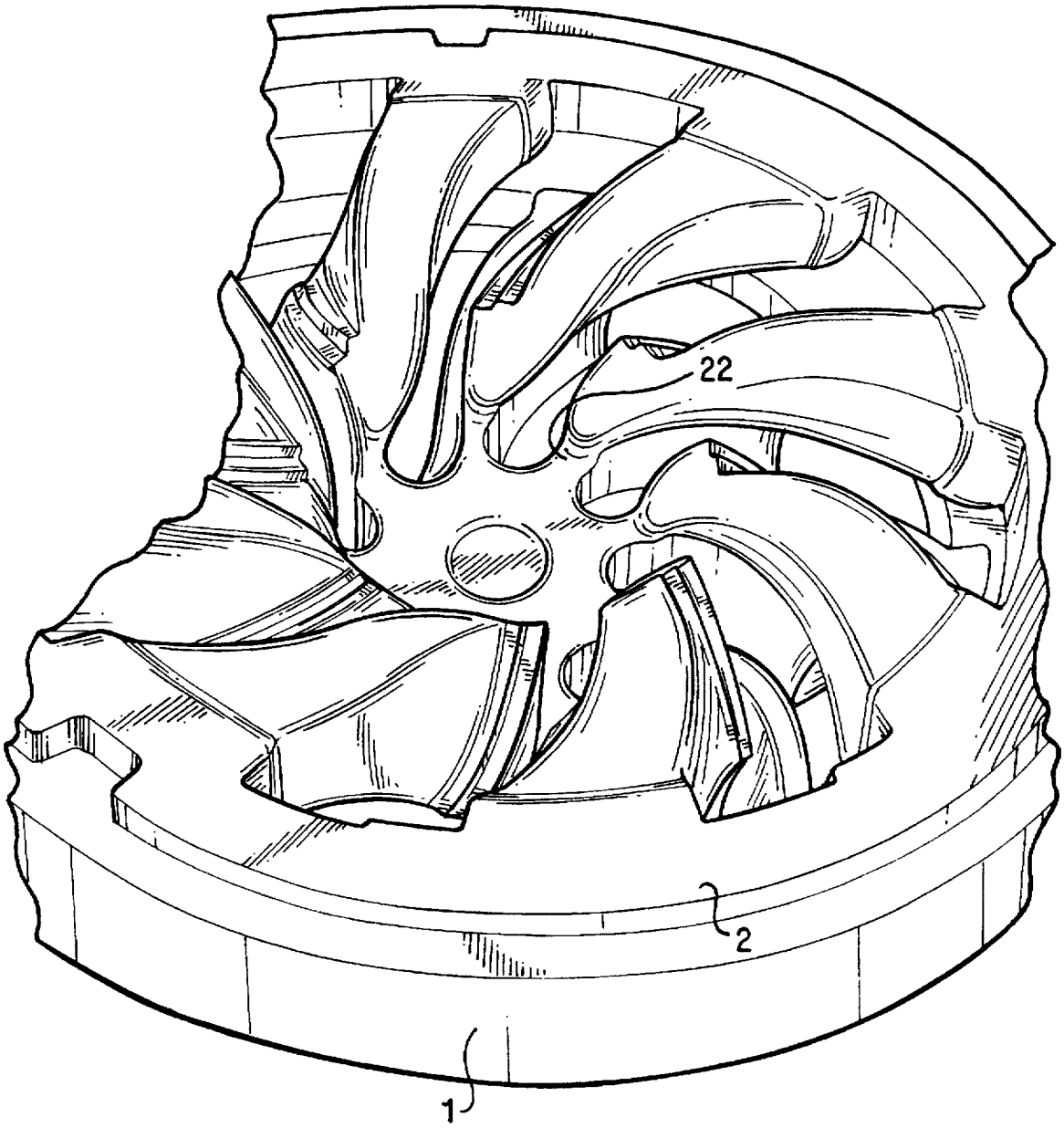
FIG. 6 is a perspective view illustrating the fitting of the second core into the first core forming the pattern used in the casting mold.
Figure 7:
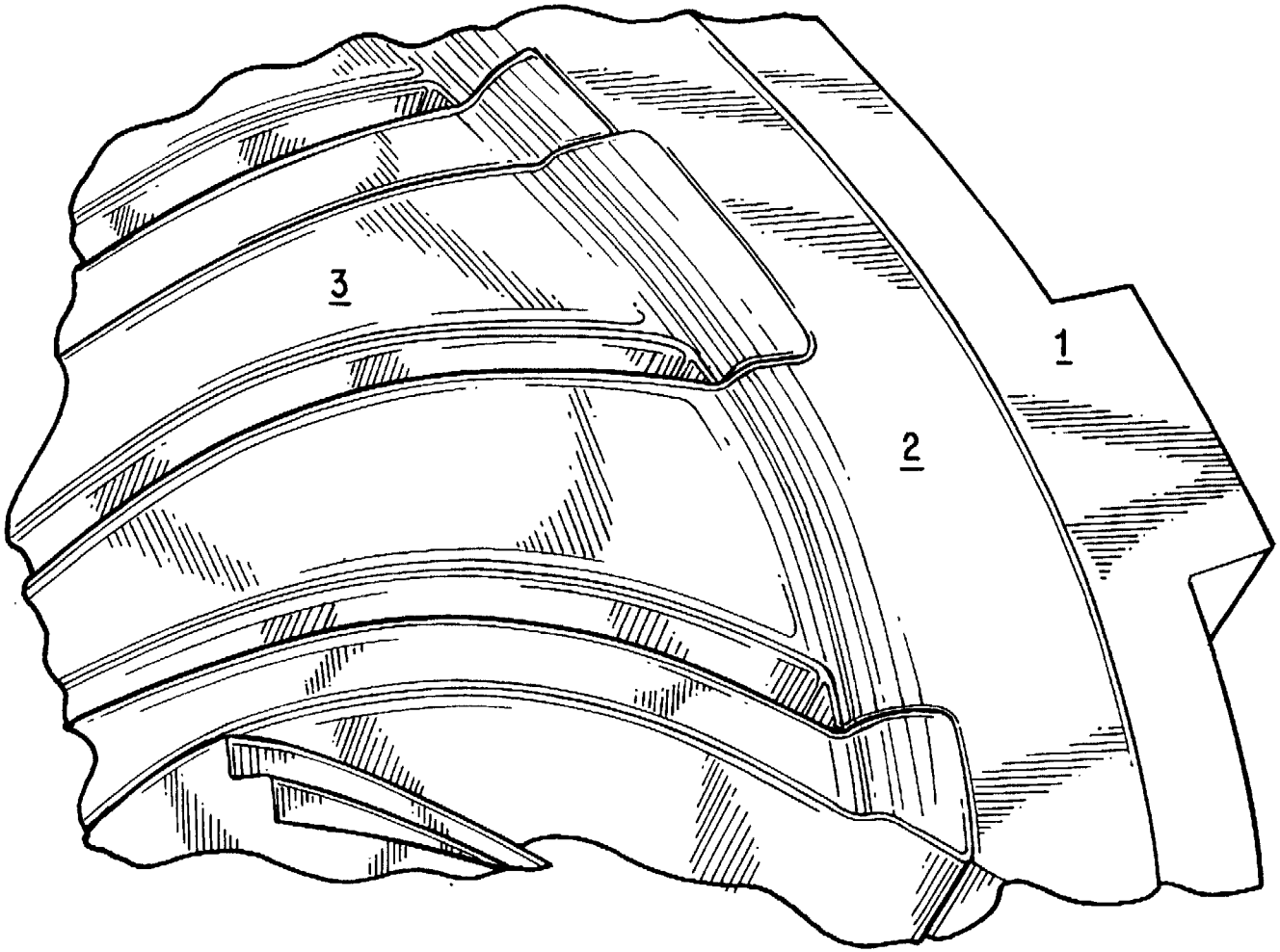
FIG. 7 is an enlarged perspective view illustrating the further core element being adhered to the second core forming the pattern used in the casting mold.

In order to form the pattern according to the present invention using the cores 1, 2, 3, FIG. 6 illustrates the manner in which the core 2 is inserted into the core 1 in an angularly defined manner. Furthermore, once cores 1 and 2 are assembled together, in a first embodiment the core 3 can be adhered to the blade shaped segment 24 of the first core 1 such as, for example, through the use of an adhesive material (FIG. 7).

Figure 8:
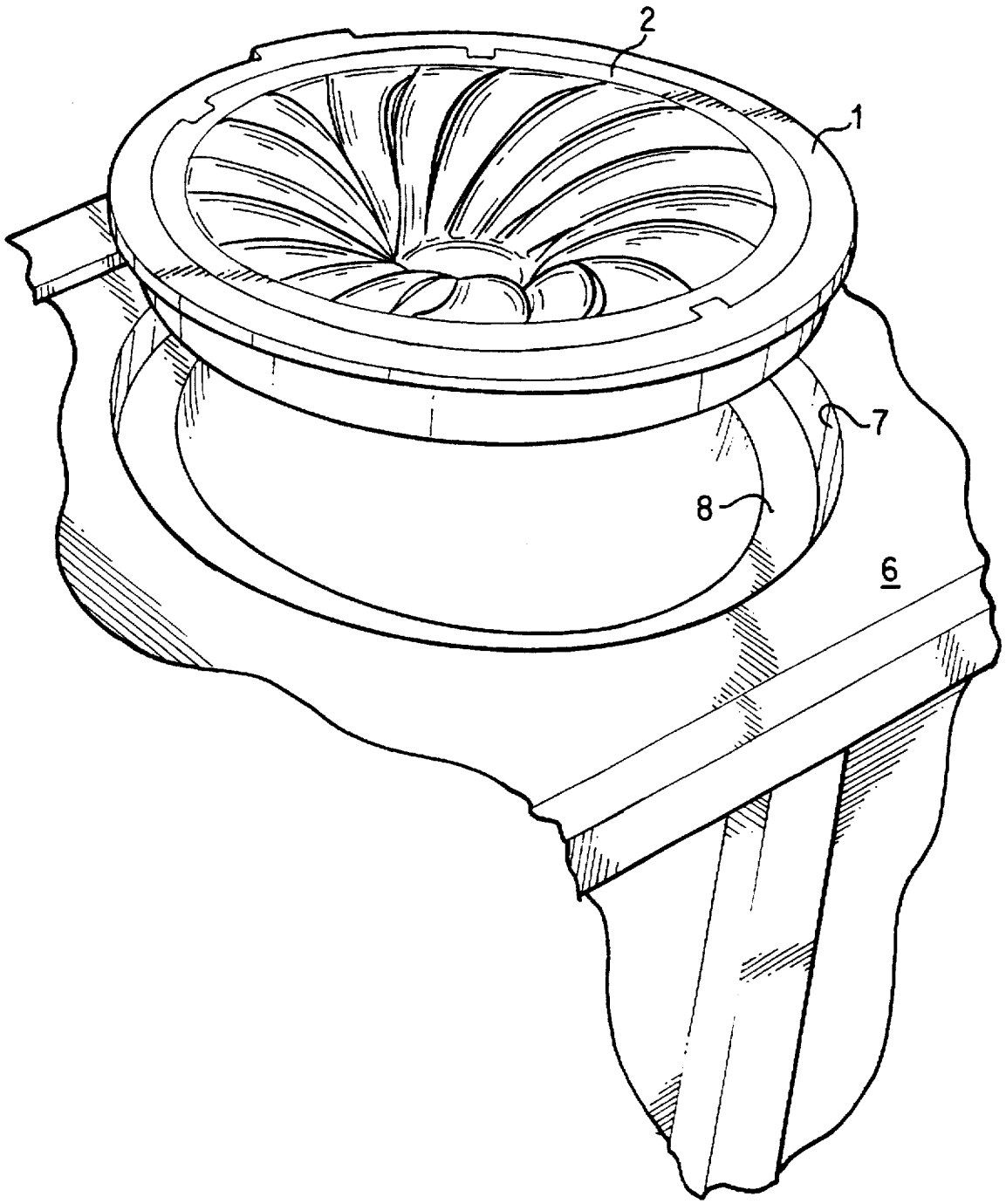
FIG. 8 is a perspective view generally illustrating the pattern according to the present invention being inserted into a molding box forming the casting mold.
Figure 9:
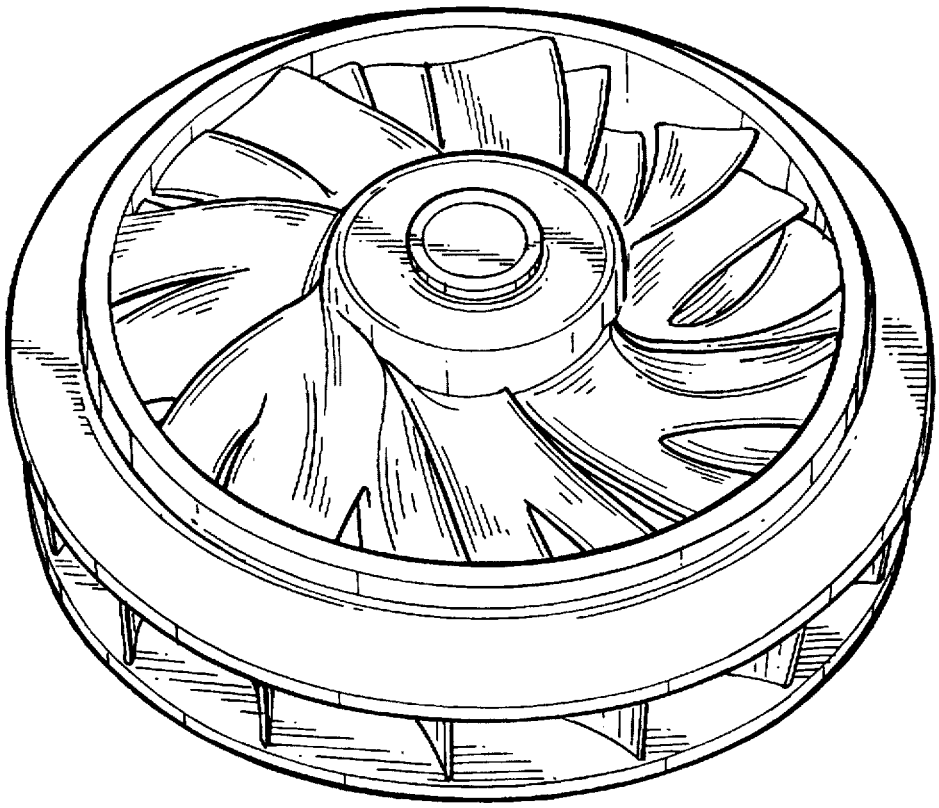
FIG. 9 is a perspective view illustrating a cast blade wheel for a turbo machine using the casting mold with the pattern according to the present invention.

Referring to FIG. 8, the entire pattern formed of the cores 1, 2, 3 is inserted into the lower box 6 in order to be used to cast a blade wheel for a turbo engine. An example of a cast blade wheel using the pattern formed of the core assembly group according to the present invention is shown in FIG. 9.

Figure 10:
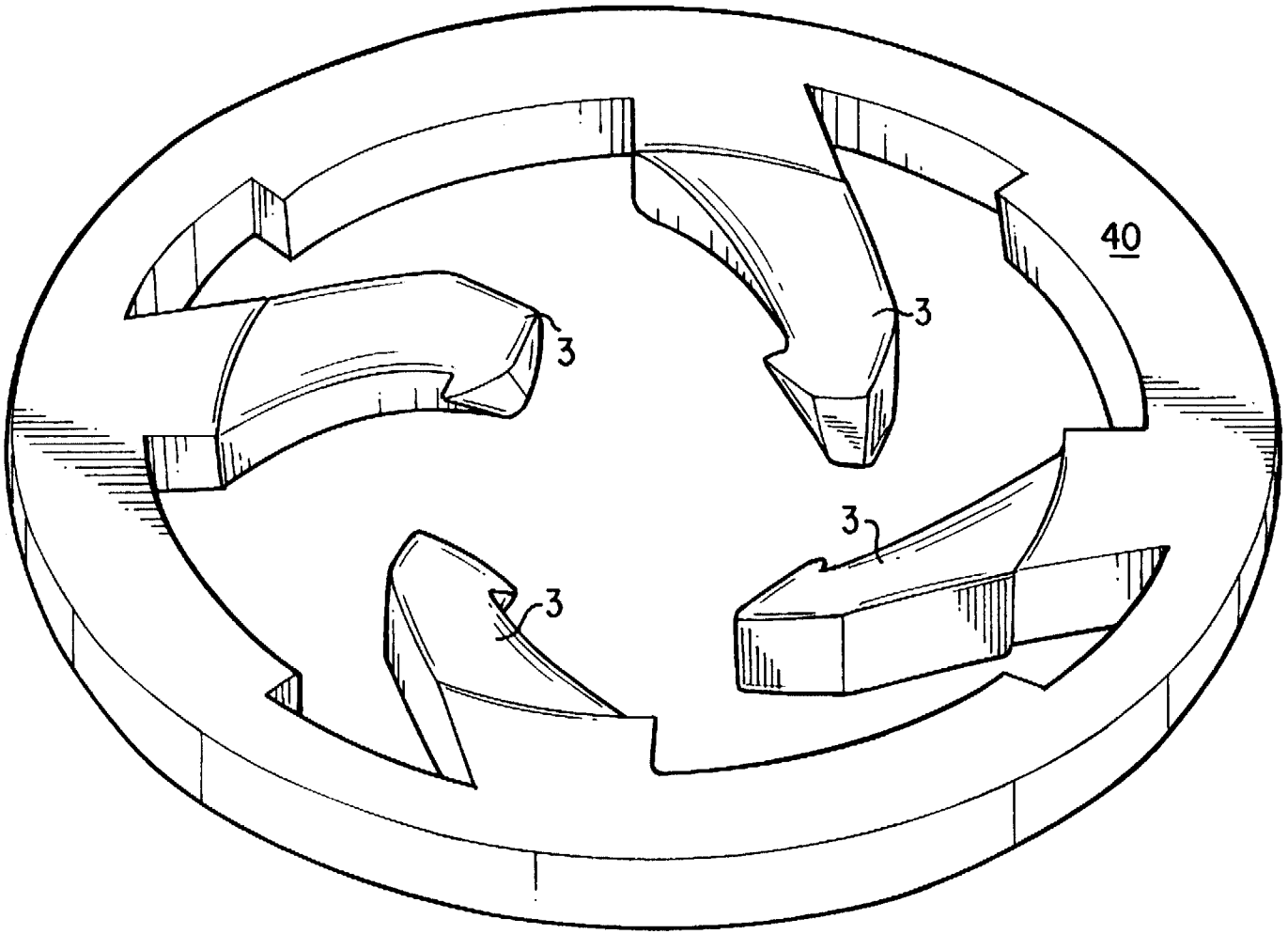
FIG. 10 illustrates a ring-shaped core mark of a further embodiment for the third core of the pattern according to the present invention used in the casting mold.

In an alternate embodiment, the cores 3 are connected together using a ring shaped core mark 40 as shown in FIG. 10. In this manner, the use of the adhesive material can be dispensed with.

Referring to FIG. 11, there is shown an exploded view of an embodiment illustrating the formation of the pattern using cores 1, 2, 3. FIG. 11 illustrates the three cores separate from one another while showing how they are fitted together in a rotational symmetrical manner with the core 3 having the ring-shaped core mark 40 being likewise fitted to the cores 1, 2 in a rotationally symmetrical manner so as to form the pattern which is then inserted into the lower box 6 of the casting mold for forming a cast blade wheel for a turbo engine.

It is an advantage of the present invention that the pattern using the core assembly group is manufactured separately and positioned in either the upper or lower box which together form a molding box unit, i.e., the casting mold. In this manner, the core assembly group forms a preform for the casting mold which does not form any part of the final product, i.e., the blade wheel, upon completion of the casting operation. Rather, the pattern is lost when the cast blade wheel is removed from the casting mold. For example, the pattern can be made of a compressed molding powder which is destroyed when the casting is completed.

It is a further advantage of the present invention that the costs associated with balancing the blade wheel are kept to a minimum in that a rotationally symmetrical and advantageously balanced pattern is used to cast the blade wheel. The casting mold according to the present invention is dimensionally stable and includes precise dimensions for forming the cast part. In view of the intricacy of the finished cast blade wheel, the casting mold must be formed of several components. The use of rotationally symmetrical components according to the present invention allows for a precise fit so as to avoid imbalance in the cast blade wheel while reducing the expenditures involved in forming the casting mold.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A model for a casting mold used to form a complete cast piece, comprising:

first and second rotationally symmetrical one-piece cores which can be fitted into one another;

said first core having a shoulder and a plurality of first blade-shaped segments extending from said shoulder lead to a first connector plate;

said second core having an exterior ring to radially rest said second core against said shoulder;

a plurality of second blade-shaped segments leading from said exterior ring to a second connector plate; and wherein at least one of said second blade-shaped segments and said exterior ring abut said first blade-shaped segments in a circumferential direction.

2. A model for a casting mold according to claim 1, wherein the first and second blade-shaped segments have contact surfaces which are essentially in parallel to a joint axis of rotation of said mold.

3. A model for a casting mold according to claim 1, wherein the first and second connector plates of the first and second cores are arranged concentrically above one another.

4. A model for a casting mold according to claim 3, wherein the second connector plate rests radially against a step of the first connector plate.

5. A model for a casting mold according to claim 1, wherein a third core is held by the first and second cores.

6. A model for a casting mold according to claim 1, wherein a third core is connected via a ring-shaped core mark and is supported via the second core.

7. A model for a casting mold according to claim 1, wherein a third core is provided with sections which engage in recesses on the exterior ring.

8. A model for a casting mold according to claim 1, wherein a third core is provided with shoulders which engage in recesses on the exterior ring.

9. A model for a casting mold according to claim 1, wherein the first blade-shaped segments of the first core engage in recesses on the exterior ring.

10. A model according to claim 1, wherein said casting mold defines a blade wheel structure for turbo-engines.

11. A pattern for a casting mold having an upper box and a lower box, comprising:

a core assembly group insertable into one of said upper and lower boxes to form the casting mold, said core assembly group comprising:

a first rotationally symmetrical one-piece core having a shoulder and several first blade-shaped segments extending from said shoulder to a first connector plate, a rotational axis of the core assembly group extends through said first connector plate;

a second rotationally symmetrical one-piece core having an exterior ring from which several second blade-shaped segments extend to a second connector plate, said second core nesting with said first core such that the exterior ring rests against the shoulder and said second connector plate is coaxially arranged about said rotational axis with said first connector plate; and a third core formed of individual core segments connected together with a ring-shaped core mark, said third core being supported via the second core.

12. A pattern according to claim 11, wherein said core segments of said third core include shoulders which engage in a circumferential direction against stops formed on at least one of said first and second cores.

13. A pattern according to claim 11, wherein each of said several first and second blade-shaped segments is designed as at least one surface of a blade so as to define a final shape of a blade after casting.

* * * * *